US006220393B1

(12) United States Patent
Oh et al.

(10) Patent No.: US 6,220,393 B1
(45) Date of Patent: Apr. 24, 2001

(54) OIL SUPPLY APPARATUS FOR LINEAR COMPRESSOR

(75) Inventors: Won Sik Oh; Kyung Bum Hur, both of Seoul; Hyeong Kook Lee, Kunpo, all of (KR)

(73) Assignee: LG Electronics, Inc. (KR)

( * ) Notice: Subject to any disclaimer, the term of this patent is extended or adjusted under 35 U.S.C. 154(b) by 0 days.

(21) Appl. No.: 09/310,784

(22) Filed: May 12, 1999

(30) Foreign Application Priority Data

May 12, 1998 (KR) ..... 98-17008
May 12, 1998 (KR) ..... 98-17009
May 12, 1998 (KR) ..... 98-17010

(51) Int. Cl.[7] ..... F01M 1/00
(52) U.S. Cl. ..... 184/6.16; 184/32; 184/46; 417/211
(58) Field of Search ..... 184/6.16, 32, 46; 417/211, 467

(56) References Cited

U.S. PATENT DOCUMENTS 5,816,783 * 10/1998 Oshima et al. ..... 417/415
5,993,175 * 11/1999 Kim et al. ..... 417/417
6,089,352 * 7/2000 Kim et al. ..... 184/6.16
6,092,999 * 7/2000 Lilie et al. ..... 417/415

* cited by examiner

*Primary Examiner*—David Fenstermacher
(74) *Attorney, Agent, or Firm*—Ostrolenk, Faber, Gerb & Soffen, LLP

(57) ABSTRACT

An oil supply apparatus for a linear compressor reduces the number of valves which control oil suction and discharge, thereby enabling fabrication and assembly of an apparatus and supplying an oil of an adequate amount to friction areas of driving elements, and increases a compression force of a mass, thereby increasing circulation volume of an oil. The oil supply apparatus for the linear compressor, includes: a compressor unit in which an oil discharge outlet is formed; an oil supply pipe disposed at an outer side of the compressor unit, an end of which communicates with an end of the oil discharge outlet; an oil valve an end of which is fixedly engaged with a side portion of the compressor unit and the other end of which is selectively in contact with the other end of the oil discharge outlet; and a discharge cover positioned at an outer side of the oil valve and engaged with the compressor unit, so that an oil path is formed between the discharge cover and the compressor unit.

26 Claims, 10 Drawing Sheets

OIL SUPPLY APPARATUS FOR LINEAR COMPRESSOR

BACKGROUND OF THE INVENTION

1. Field of the Invention

The present invention relates to an oil supply apparatus for a linear compressor, and more particularly to an oil supply apparatus for a linear compressor which reduces the number of valves which control suction and discharge of an oil, thereby enabling fabrication and assembly thereof, and supplying an oil of an adequate amount to friction areas of driving elements.

2. Description of the Conventional Art

As generally well known, a linear compressor compresses a refrigerant by reciprocating a piston in a cylinder using a magnet and a coil, instead of a crank shaft.

FIG. 1 illustrates a conventional linear compressor. As shown therein, the conventional linear compressor includes a compressor unit 10 horizontally provided in a hermetic vessel C having a predetermined shape and sucking, compressing, and discharging a refrigerant, and an oil supply unit 20 disposed at an outer side of the compressor unit 10 and supplying an oil to friction areas of driving elements of the compressor.

More particularly, in the compressor unit 10 there are provided a cylinder 12 connected with a stator 11*a* (inner and outer laminations) as a single body and a piston 13 which is connected with a rotor (including a magnet) 11*b* of a linear motor 11 and reciprocates into the cylinder 12.

The oil supply unit 20, as shown in FIG. 2, consists of an oil supply pipe 21 disposed at an outer side of the compressor unit 10, a suction cover 22 engaged with an end of the oil supply pipe 21 at an oil suction side and having a suction inlet 22*a* at a bottom thereof, and a discharge cover 23 engaged with the other end of the oil supply pipe 21 at an oil discharge side and connected to one side of the compressor unit 10.

Further, in the oil supply pipe 21, there are provided a mass 24 in which there is formed a first oil path 24*a* communicating with the suction cover 22 and the discharge cover 23, respectively, the mass sucking and discharging the oil which is moved by the reciprocation of compressor unit 10 and placed at a bottom of the hermetic vessel C, first and second compression coil springs 25A, 25B, respectively connected between both ends of the mass 24 and ends of inner surfaces of both sides of the oil supply pipe 21, a suction valve 26 which is connected with an end of the first compression coil spring 25*a* and in contact with an inner surface of the suction cover 22, thereby allowing or blocking the flow of the oil which flows thereinto through the suction opening 22*a* formed at the bottom of the suction cover 22, and a discharge valve 27 which is connected with an end of the second compression coil spring 25*b* and in contact with an end portion of an oil discharge side of the mass 24, thereby allowing or blocking the flow of the oil which has passed through the first oil path 24*a*.

As shown in FIG. 3, the suction valve 26 and the discharge valve 27 are respectively formed in a scroll type, in which opening/closing units 26*a*, 27*a* are provided in each center thereof.

Now, the operation of the conventional linear compressor will be described with reference to the accompanying drawings.

When an electric current is applied to the linear motor 11, the rotor 11*b* linearly reciprocates and accordingly the piston 13 reciprocates in the cylinder 12. As the piston 13 reciprocates in the cylinder 12, the refrigerant gas flowing into the hermetic vessel C is sucked into a compression chamber (not shown) of the cylinder 12, passing through a refrigerant oil path 13*a* provided in a center of the piston 13.

Being supported to move in the hermetic vessel C, the compressor unit 10 regularly vibrates by the driving of the linear motor 11 and accordingly the oil supply pipe 21 of the oil supply unit 20 reciprocates from side to side by the vibration of the compressor unit 10. Here, the mass 24 located in the oil supply pipe 21 moves due to inertial force produced by the reciprocation of the oil supply pipe 21, so that the oil O located in the bottom of the hermetic vessel C is sucked into the oil supply pipe 21 by pressure difference between the portions formed at both sides of the mass 24. Thus, the oil flowing into the oil supply pipe 21 passes through the first oil path 24*a* provided in the mass 24 and then a second oil path 23*a* in the discharge cover 23, and is discharged into an oil pocket P, thereby being supplied to a slide portion formed between the cylinder 12 and the piston 13. Numerals 14 and 15 are a head cover and a valve, respectively. 16 and 17 respectively indicate a coil spring, and 18 and 19 are an external refrigerant suction pipe and a mounting spring, respectively.

However, the oil supply apparatus for the conventional linear compressor has several problems.

First, since the size of the suction valve and the discharge valve that control the suction and the discharge, respectively, of the oil is small, the fabrication and assembly are not easily achieved, thereby decreasing the productivity.

Second, since the suction and discharge valves are compressed and fixed by the compression coil springs supporting the mass, the opening/closing units of the suction and discharge valves are controlled by the compression coil springs, so that the valves can not properly control the suction and discharge of the oil.

Third, since the oil path is provided in the mass, the weight of the mass is reduced as the volume of the oil path so that the compressing force of the mass is reduced and thus the circulation volume of the oil is reduced.

SUMMARY OF THE INVENTION

Accordingly, the present invention is directed to an oil supply apparatus for a linear compressor which obviates the problems and disadvantages in the conventional art.

An object of the present invention is to provide an oil supply apparatus for a linear compressor that reduces the number of valves which control oil suction and discharge, thereby enabling more efficient fabrication and assembly thereof.

Another object of the present invention is to provide an oil supply apparatus for a linear compressor that supplies an oil of an adequate amount to friction areas of driving elements by having free ends of a valve not contacting with other constituent elements, thereby improving reliability of the compressor.

Still another object of the present invention is to provide an oil supply apparatus for a linear compressor that reduces dead volume of a space formed between a mass and an oil supply pipe to increase a compression force of the mass, thereby increasing circulation volume of an oil.

To achieve these and other advantages and in accordance with the purpose of the present invention, as embodied and broadly described herein, there is provided an oil supply apparatus for a linear compressor which includes: a compressor unit in which an oil discharge outlet is formed; an oil supply pipe disposed at an outer side of the compressor unit, an end of which communicates with an end of the oil discharge outlet; an oil valve an end of which is fixedly engaged with a side portion of the compressor unit and the other end of which is selectively in contact with the other end of the oil discharge outlet; and a discharge cover positioned at an outer side of the oil valve and engaged with the compressor unit, so that an oil path is formed between the discharge cover and the compressor unit.

Also, to achieve the above objects of the present invention, there is provided an oil supply apparatus for a linear compressor which includes: a compressor unit; a discharge cover engaged with the compressor unit, in which there is formed an oil path communicating with an oil pocket of the compressor unit; an oil supply tube an upper semicircle of an open end of which is compressively inserted into an end of the discharge cover; and an oil valve disposed at a connection area of the oil supply tube and the discharge cover.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Figure 1:
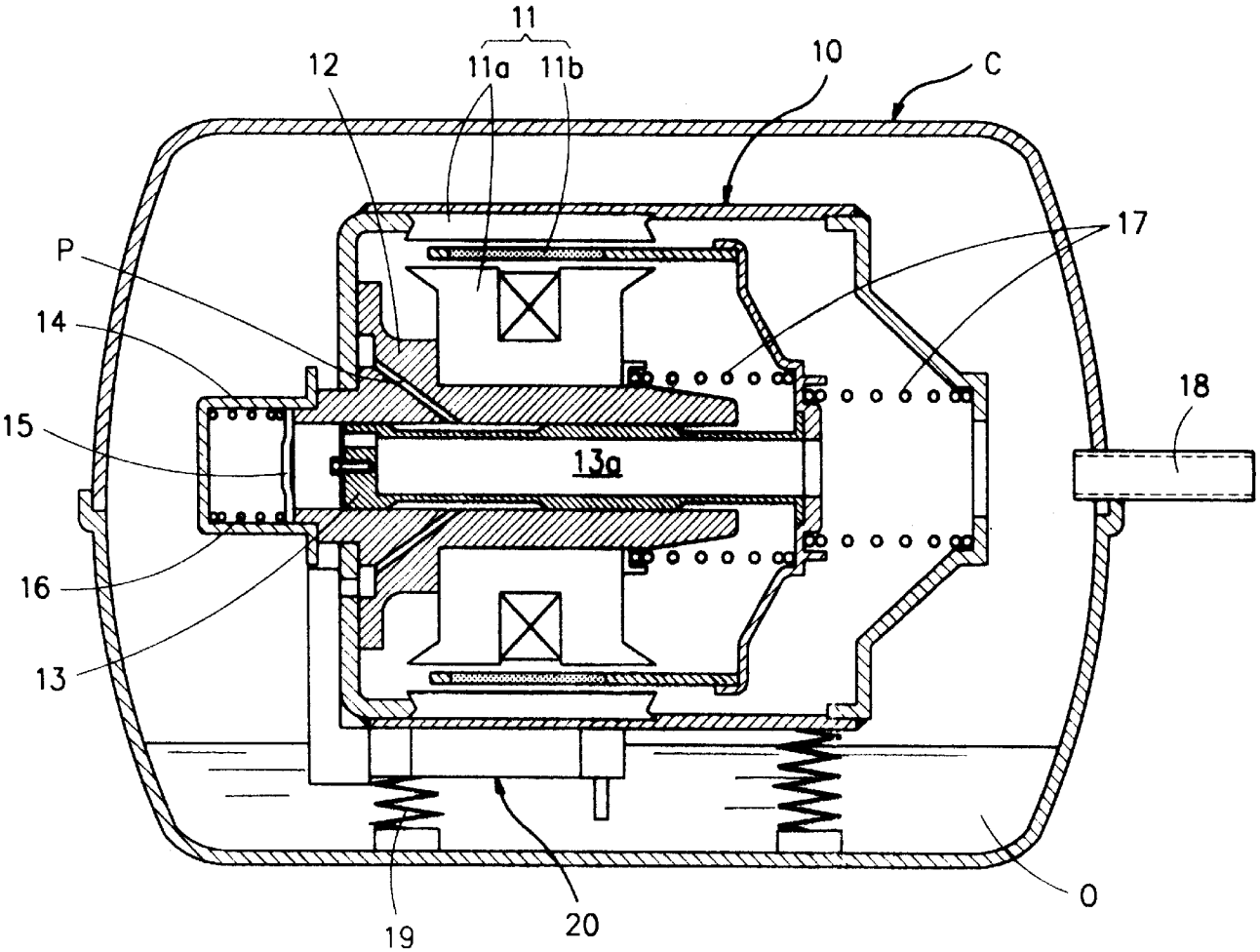
FIG. 1 PRIOR ART
FIG. 1 a vertical cross-sectional view of a conventional linear compressor.
Figure 2:
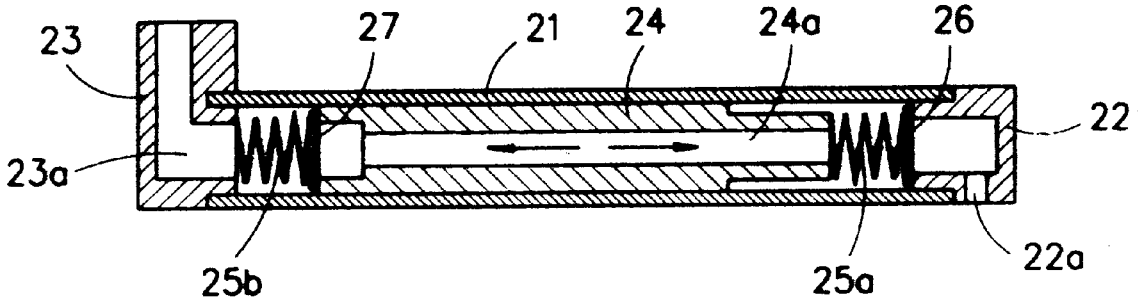
FIG. 2 PRIOR ART
FIG. 2 is a vertical cross-sectional view illustrating an oil supply apparatus of a conventional linear compressor.
Figure 3:
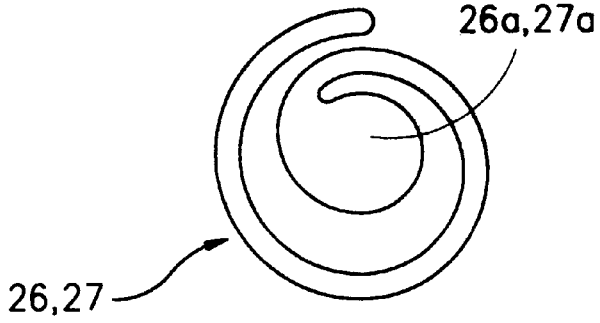
FIG. 3 PRIOR ART
FIG. 3 is a front view illustrating a suction valve and a discharge valve of an oil supply apparatus of a conventional linear compressor.

Reference will now be made in detail to the preferred embodiments of the present invention, examples of which are illustrated in the accompanying drawings.

In the present invention, those which are identical to the elements in the conventional art will have the same numerals.

As shown in FIGS. 4 through 8B, in an oil supply apparatus for a linear compressor according to a first embodiment of the present invention, an oil supply pipe 110 which is an oil supply means is disposed at an outer side of a compressor unit 10. A mass 120, which sucks and discharges an oil to/from the oil supply pipe 110 by pressure difference which is produced by inertial force due to the reciprocation of the oil supply pipe 110, is inserted in the oil supply pipe 110 and first and second compression coil springs 131, 132 are respectively connected with both ends of the mass 120.

Further, at an oil suction side of the oil supply pipe 110, a suction cover 140 supporting the other end of the first compression coil spring 131 is attachedly fixed to the compressor unit 10, being compressively inserted in an end portion of the oil supply pipe 110 at the oil suction side. An oil discharge outlet 10*a* is provided in the compressor unit 10 supporting the other end of the second compression coil spring 132, one side of the oil discharge outlet 10*a* communicating with the oil supply pipe 110 and the other side thereof selectively contacting with an end of an oil valve 160, the other end of which is fixedly connected with the compressor unit 10. The oil valve 160 controls the volume of the oil which is sucked and discharged to/from the oil supply pipe 110. A discharge cover 150 is disposed at the outer side of the oil valve 160, the discharge cover 150 being connected with the compressor unit 10 in order that an oil path 151 is formed between the compressor unit 10 and the discharge cover 150. In other words, in the present invention, an oil valve is substituted for the suction valve and the discharge valve employed in the conventional oil supply apparatus, thereby reducing the number of the constituent elements of the oil supply apparatus.

Figure 5:
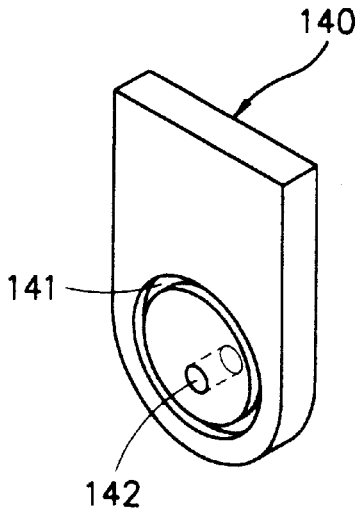
FIG. 5 is a perspective view illustrating a suction cover of an oil supply apparatus for a linear compressor according to a first embodiment of the present invention.

To describe the suction cover 140 in more detail, as shown in FIG. 5, a ring-shaped groove 141 is formed on a center of a lower side of a side surface of the suction cover 140 facing the oil supply pipe 110, the groove 141 compressively receiving an end of the oil suction portion of the oil supply pipe 110, and an oil suction inlet 142 is formed in the center of the groove 141, the oil suction inlet 142 becoming a path through which the oil placed in a bottom of the hermetic vessel C is flowed into the oil supply pipe 110 by the vibration of the oil supply pipe 110.

Here, it is noted that, the oil suction inlet 142 is formed smaller than the oil discharge outlet 10*a*.

Figure 6:
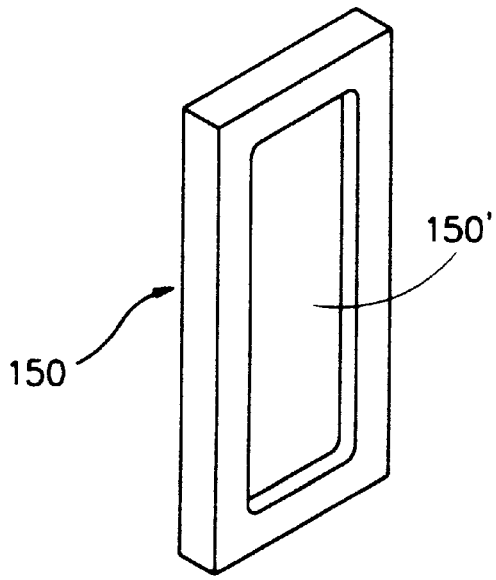
FIG. 6 is a perspective view illustrating a discharge cover of an oil supply apparatus for a linear compressor according to a first embodiment of the present invention.

Further, as shown in FIG. 6, a vertically longitudinal rectangular recess 150' is formed on a center of a side surface of the discharge cover 150 facing the oil supply pipe 110. Here, a width of the recess 150' is formed larger than that of the oil valve 160, for thereby receiving the oil valve 160 and a length thereof is formed longer than that of the oil valve 160 so that the oil valve 160 can move therein.

Figure 7:
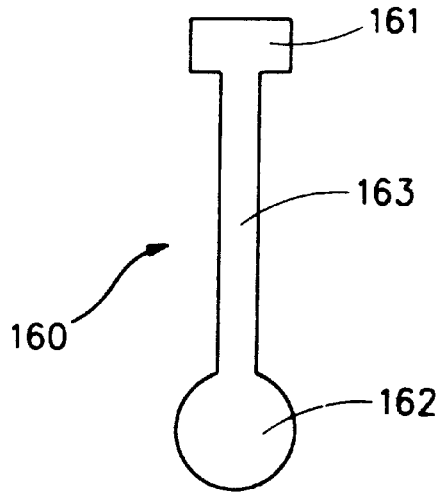
FIG. 7 is a front view illustrating an oil valve of an oil supply apparatus for a linear compressor according to a first embodiment of the present invention.

As shown in FIG. 7, the oil valve 160 consists of a body 163, a mounting portion 161 which forms a 'T' shape with the body 163 and is attached to one side of the compressor unit 10, and a ring-shaped opening/closing unit 162 formed at a bottom of the body 163 and extended to the end of the oil supply pipe 110 at the oil discharge side.

Now, an operation of the oil supply apparatus for the linear compressor according to the first embodiment of the present invention will be described with the reference to the accompanying drawings.

When the current is applied to the linear motor 11 of the compressor unit 10, the piston 13 reciprocates in the cylinder 12 with the rotor 11*b* and accordingly the refrigerant gas sucked into the hermetic vessel C is flowed into the compression chamber (not shown) of the cylinder 12, passing through the refrigerant path 13*a* provided in the center of the piston 13, and then discharged therefrom, the above-mentioned process being repeatedly performed.

Figure 4:
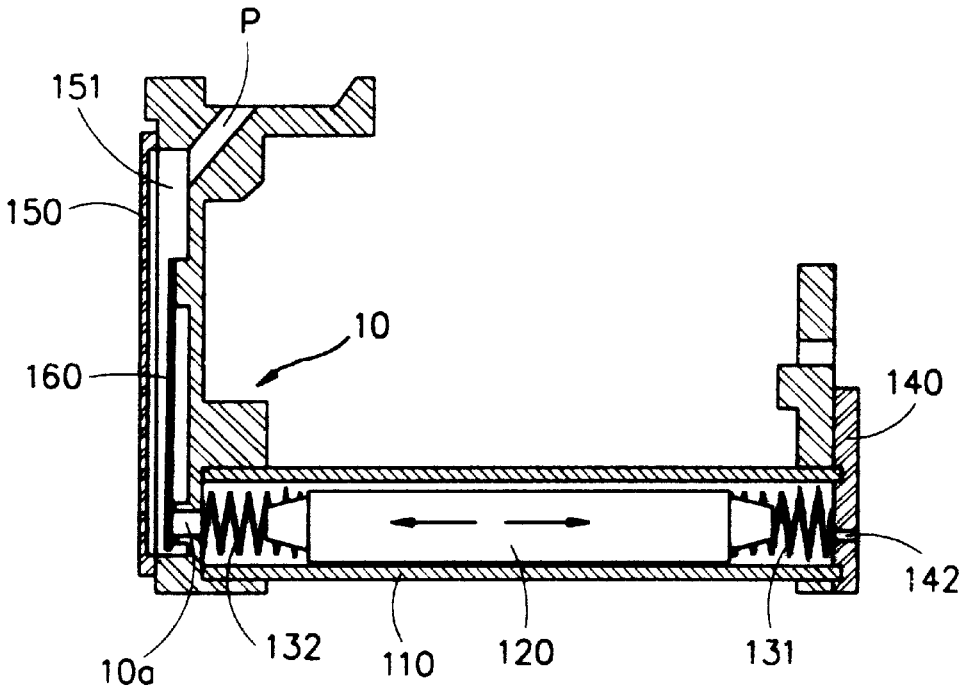
FIG. 4 is a vertical cross-sectional view of an oil supply apparatus for a linear compressor according to a first embodiment of the present invention.

Here, as described above, the oil supply pipe 110 reciprocates from side to side as shown in FIG. 4 with the compressor unit 10 and the mass 120 located in the oil supply pipe 10 inertially moves due to the reciprocation of the oil supply pipe 10.

The oil which is placed at the bottom of the hermetic vessel C by the inertial movement of the mass 120 is sucked into the oil supply pipe 110 due to the pressure difference between both ends of the mass 120 and then discharged to the oil pocket P through the oil path 151 formed by the discharge cover 150 and the compressor unit 10.

Figure 8A:
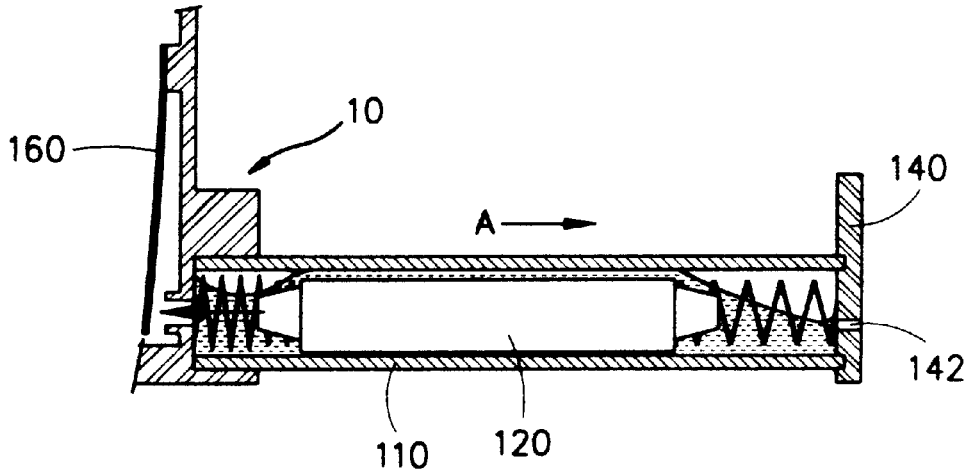
FIG. 8A is a vertical cross-sectional view illustrating an open condition of an oil valve in an oil supply apparatus for a linear compressor according to a first embodiment of the present invention.

Specifically, as shown in FIG. 8A, when the oil supply pipe 110 moves to a direction 'A', the mass 120 moves opposite to the direction 'A' due to the inertial force, so that a portion of the oil supply pipe 110 at the oil suction side has a lower pressure than a portion thereof at the oil discharge side. Accordingly, the oil placed at the bottom of the hermetic vessel C is flowed into the oil supply pipe 110 through the oil suction inlet 142 formed in the suction cover 140. While, the oil placed in the oil supply pipe 110 and moving towards the oil discharge side in accordance with the movement of the mass 120 moves the oil valve 160 in the direction being distant from the oil discharge outlet 10*a*, thereby opening the oil discharge outlet 10*a*, and the oil discharged through the oil discharge outlet 10*a* is sucked into the oil pocket P of the compressor unit 10 through the oil path 151 formed between the oil discharge cover 150 and the compressor unit 10.

Figure 8B:
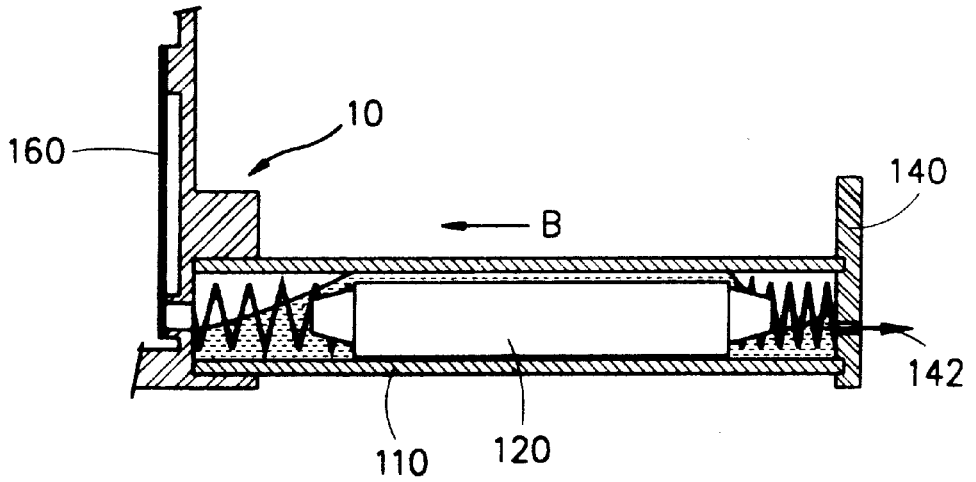
FIG. 8B is a vertical cross-sectional view illustrating a closed condition of an oil valve in an oil supply apparatus for a linear compressor according to a first embodiment of the present invention.

On the contrary, as shown in FIG. 8B, when the oil supply pipe 110 moves to a direction 'B', the mass 120 moves opposite to the direction 'B' due to the inertial force, so that the portion of the oil supply pipe 110 at the oil discharge side has a lower pressure than the portion thereof at the oil suction side. Thus, the oil valve 160 moves to the oil discharge outlet 10*a* thereby closing the oil discharge outlet 10*a*, and the oil which flows to the oil suction side from the inner part of the oil supply pipe 10 by the movement of the mass 120 is partially discharged to the bottom of the hermetic vessel C through the oil suction inlet 142 of the suction cover 140 and prevented from being sucked into the oil supply pipe 110, the above process being repeatedly performed.

That is, since the oil valve 160 is disposed at the outer side of the oil supply pipe 110 at the oil discharge outlet side, not the inside of the oil supply pipe 110, the oil valve 160 is not restricted by its size, thereby enabling the fabrication and assembly of the oil supply apparatus for the linear compressor. Further, since the oil valve 160 does not contact with the compression coil springs 131, 132 in the assembly process, the assembly thereof becomes easier and the reliability thereof can be secured. In addition, although it is not separately illustrated, the objects of the present invention can be achieved by applying a general embodiment using the inertial force of the oil, excluding the mass and the compression coil springs in the first embodiment of the present invention.

Now, with the accompanying drawings, an oil supply apparatus for a linear compressor according to a second embodiment of the present invention will be described in detail.

Figure 9:
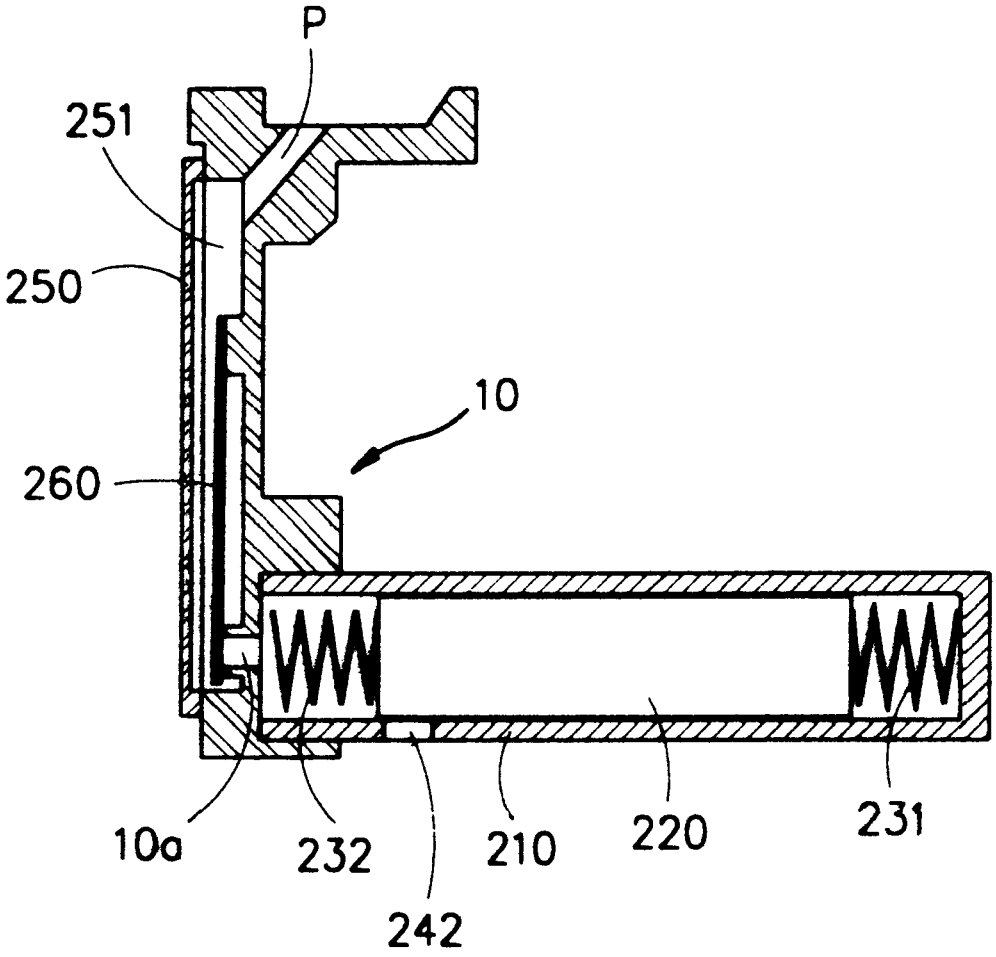
FIG. 9 is a vertical cross-sectional view of an oil supply apparatus for a linear compressor according to a second embodiment of the present invention.

Since the oil supply apparatus for the linear compressor according to the second embodiment of the present invention is similar to that according to the first embodiment, the oil supply apparatus according to the first embodiment of the present invention will be described in various aspects different from the first embodiment. As shown in FIGS. 9 through 10B, instead of using the suction cover 140 employed in the first embodiment, an end of an oil supply pipe 210 is closed. Further, an oil suction inlet 242 is formed at a predetermined portion of a bottom of the oil supply pipe 210 at an oil discharge side into which a mass 220 is slid. In addition, to increase the circulation volume of the oil by reducing the dead volume of the space formed between the oil supply pipe and the mass, an outer circumferential surface of the mass 220 is tightly slid into an inner circumferential surface of the oil supply pipe 210, so that the oil is not discharged from the space formed between the outer circumferential surface of the mass 220 and the inner circumferential surface of the oil supply pipe 210. Here, the mass 220 which inertially moves in the oil supply pipe 210 opens the oil suction inlet 242 when sucking the oil and closes the oil suction inlet 242 when discharging the oil.

While, in the second embodiment of the present invention, the oil valve 260 located between a discharge cover 250 and an oil discharge outlet 10*a* of the oil supply pipe 210 blocks the oil discharge outlet 10*a* of the oil supply pipe 210 when the oil is sucked, and moves in the direction being distant from the oil discharge outlet 10*a*.

Now, the operation of the oil supply apparatus for the linear compressor according to the second embodiment of the present invention will be described with the accompanying drawings.

In the oil supply apparatus according to the second embodiment of the present invention, there will be explained, in particular, a process of which the oil supply pipe 210 sucks the oil in the hermetic vessel C while vibrating by the vibration of the compressor unit 10, thereby supplying the oil to a slide portion formed between the cylinder 12 and the piston 13, without describing the basic description thereof.

Figure 10A:
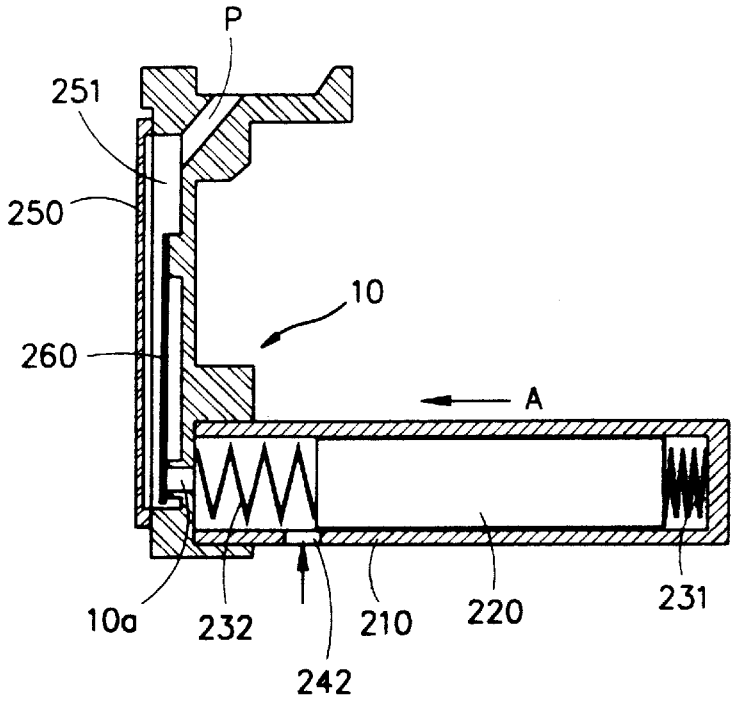
FIG. 10A is a vertical cross-sectional view illustrating a location of an oil valve when sucking an oil according to a second embodiment of the present invention.
Figure 10B:
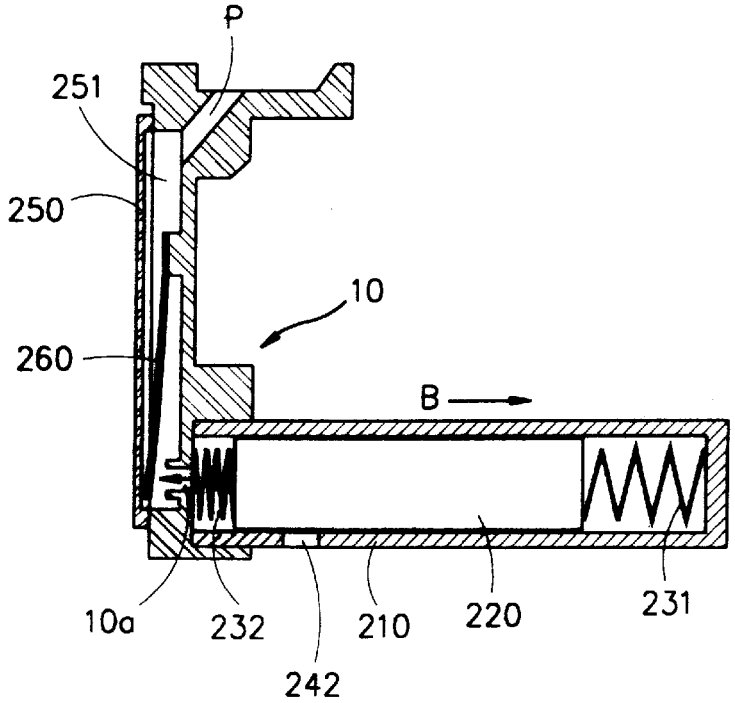
FIG. 10B is a vertical cross-sectional view illustrating a location of an oil valve when discharging an oil according to a second embodiment of the present invention.

First, as shown in FIG. 10A, when the oil supply pipe 210 moves in a direction 'A', the mass 220 moves opposite to the direction 'A' due to the inertial force, so that a portion of the oil supply pipe 210 at the discharge cover side has a relatively lower pressure. Accordingly, the oil valve 260 moves towards the oil supply pipe 210, thereby closing the oil discharge outlet 10*a* and due to the movement of the mass 220 the oil suction inlet 242 is opened, so that the oil placed in the bottom of the hermetic vessel C is sucked into the oil supply pipe 210.

On the contrary, as shown in FIG. 10B, when the oil supply pipe 210 moves to a direction 'B', the mass 220 moves opposite to the direction 'B' due to the inertial force, so that a portion of the oil supply pipe 210 at the oil discharge side has a relatively lower pressure. Thus, the oil placed in the oil supply pipe 210 moves the oil valve 20 in the direction being distant from the oil discharge outlet 10*a*, thereby opening the oil discharge outlet 10*a*, so that the oil is discharged to the oil path 251 and an outer circumferential surface of the mass 220 covers the oil suction inlet 242 due to which the mass 220 moves towards the oil discharge outlet 10*a*.

That is, in the second embodiment of the present invention, the oil supply pipe 210 is formed in a cylindrical shape and the oil suction inlet 242 and the oil discharge outlet 10*a* are provided together at the same side of the oil supply pipe 210 on the basis of the mass 220, and particularly the oil suction inlet 242 is formed at a slide surface so as to be open and closed by the mass 220 which slides in the oil supply pipe 210. 231 and 232 are compression coil springs which are connected to both ends of the mass 220.

Figure 11:
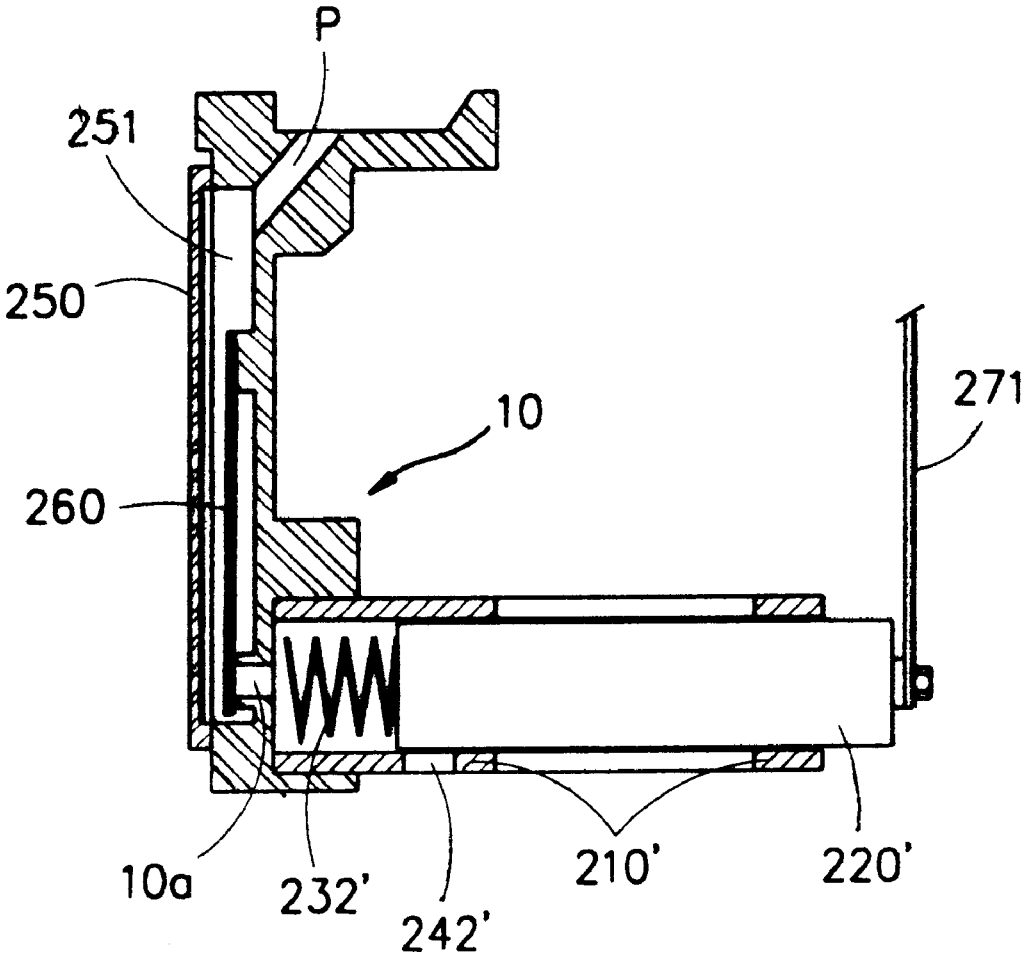
FIG. 11 is a vertical cross-sectional view illustrating a modification of an oil supply apparatus for a linear compressor according to a second embodiment of the present invention.
Figure 12:
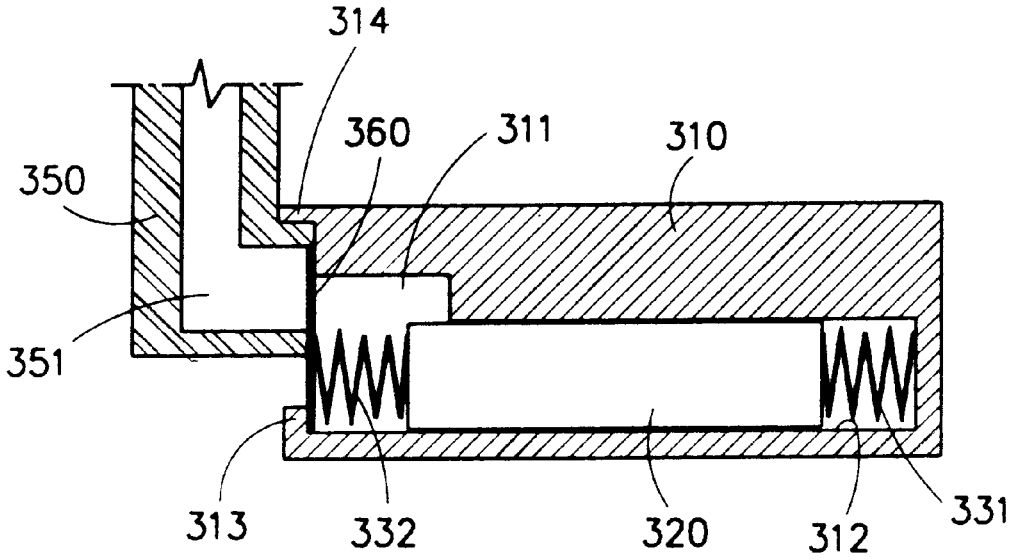
FIG. 12 is a vertical cross-sectional view of an oil supply apparatus for a linear compressor according to a third embodiment of the present invention.

FIG. 11 illustrates a modified example of the oil supply apparatus for the linear compressor according to the second embodiment of the present invention. As shown therein, a mass 220' is not placed in a single oil supply pipe, but a plurality of oil supply pipes 210' each of which is formed in a ring shape are disposed in parallel so that the mass 220' is flexibly slid to an inner circumferential surface of each of the oil supply pipe 210'. Here, an oil suction inlet 242' is formed in a bottom of one of the oil supply pipes 210' which is disposed at the oil discharge side. Further, elastic members are provided at both ends of the mass 220' inserted into the oil supply pipes 210' —one is a compression coil spring 232' provided at an end of the oil discharge outlet 10*a* and the other is a plate spring 271 protruded form the oil supply pipe 210'. The operation of the oil supply apparatus according to the modification of the second embodiment of the present invention is the same as the that of the second embodiment of the present invention.

In the oil supply apparatus for the linear compressor according to the second embodiment of the present invention, since the single valve 260 is only employed and disposed out of the oil supply pipe 210, 210', the overall assembly becomes easier and the dead volume of the space formed between the mass 220, 220' and the oil supply pipe 210, 210' is reduced, thereby increasing the circulation volume of the oil.

In other words, the oil valve is disposed out of a portion of the oil supply means on the oil discharge side and the oil suction inlet is formed at the slide surface of the oil supply means, particularly, on the same side as the oil discharge outlet in the basis of the mass, so that the oil suction inlet is naturally open and closed, being covered or uncovered by the mass, in the sliding of the mass, thereby increasing the circulation volume of the oil.

Next, an oil supply apparatus for a linear compressor according to a third embodiment of the present invention will be described with reference to the accompanying drawings.

In the oil supply apparatus for the linear compressor according to the third embodiment of the present invention, in an oil supply tube 310 of a hollow cylindrical type which is an oil supply means disposed at an outer side of the compressor unit 10, an end thereof is connected with a discharge cover 350 under the condition of which a lower semicircle of the end thereof is open.

That is, as shown in FIGS. 12 through 14B, the oil supply tube 310 is connected with the compressor unit 10 by which an upper semicircle portion of the end of the oil supply tube 310 at the oil discharge side is compressively inserted into the discharge cover 350. In addition, an end of the oil supply tube 310 is closed, instead of using the suction cover 140 employed in the first embodiment of the present invention.

Figure 13:
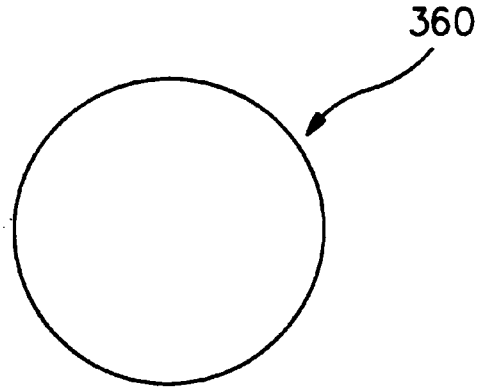
FIG. 13 is a front view illustrating an oil valve of an oil supply apparatus for a linear compressor according to a third embodiment of the present invention.

Further, an oil valve 360 formed in a disk type is disposed at a connecting area of the oil supply tube 310 and the discharge cover 350 in order to selectively communicate the oil supply tube 310 with the discharge cover 350 in accordance with the moving direction of the oil supply tube 310, the oil valve 360, as shown in FIG. 13, being disposed from a top to a bottom of the inside of the oil supply tube 310 and a center of which being fixed by a bottom of the discharge cover 350.

While, a mass 320 is inserted in the oil supply tube 310, the mass 320 sucking/discharging the oil to/from the oil supply tube 310 by the pressure difference due to the inertial force produced by the oil supply tube 310 which reciprocates by the vibration of the compressor unit 10, and first and second compression coil springs 331, 332 are respectively connected with both ends of the mass 320. Further, an end of the second coil spring 332 which is placed at the open end of the oil supply tube is fixed at the center portion of the oil valve 360. Here, it is noted that the inside of the oil supply tube 310 becomes narrower, as being distanced from the oil discharge side, by which the inner portion of the oil supply tube 310 is formed being stepped at least twice. That is, a discharge cover and oil valve receiving unit 314 is formed at the end of the oil supply tube 310 at the discharge cover side, and a suction/discharge unit 311 is formed in a space which is formed being stepped towards the opposite side of the discharge cover 350 from the discharge cover and oil valve receiving unit 314, to receive the second compression coil spring 332 and an end portion of the mass 320. Further, the mass 320 and a mass sliding portion 312, into which the first compression coil spring 331 is inserted, are provided in the space which is formed being stepped from the suction/discharge unit 311 towards the oil suction side. While, an oil valve latching protrusion 313 is upwardly protruded from an end of the bottom of the oil supply tube 310 which is placed directly under the discharge cover and oil valve receiving unit 314.

As described above, the center of one side of the oil valve 360 is fixed to the bottom of the discharge cover 350, and the center of the side thereof is connected with the second compressing spring 332 supporting the mass 320. Thus, the upper part of the oil valve 360 selectively opens/closes the oil discharge side of the oil supply tube 310 and the lower part thereof selectively opens/closes the oil suction side of the oil supply tube 310.

Now, an operation of the oil supply apparatus for the linear compressor according to the third embodiment of the present invention will be described with the accompanying drawings.

In the oil supply apparatus according to the third embodiment of the present invention, there will be explained, in particular, a process of which the oil supply tube 310 sucks the oil in the hermetic vessel C while vibrating by the vibration of the compressor unit 10, thereby supplying the oil to a slide portion between the cylinder 12 and the piston 13.

Figure 14A:
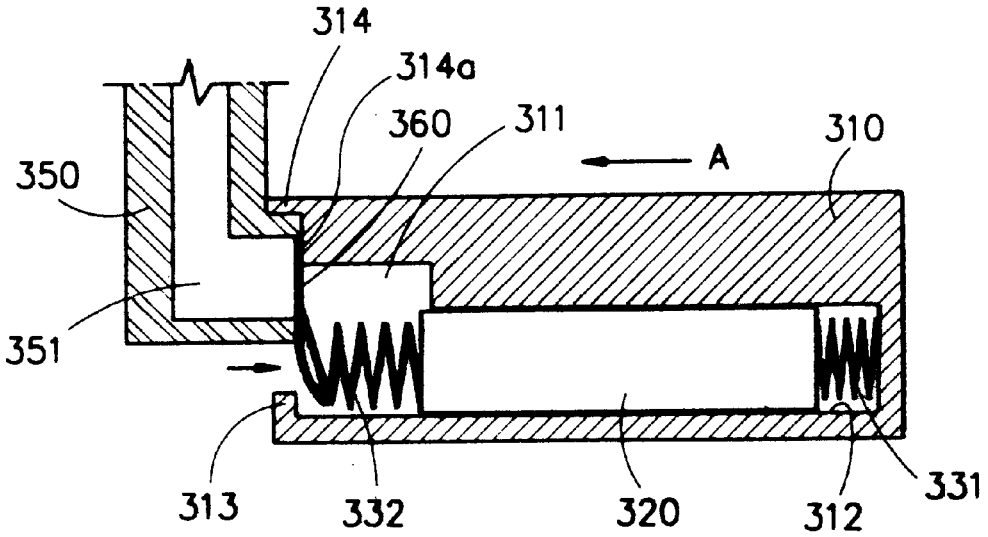
FIG. 14A is a vertical cross-sectional view illustrating a location of an oil valve when sucking an oil according to a third embodiment of the present invention.

That is, as shown in FIG. 14A, when the oil supply tube 310 moves in a direction 'A', the mass 320 moves opposite to the direction 'A' by the inertial force, so that the space of the suction/discharge unit 311 is relatively larger than the space of the sliding portion 312 of the mass 320 and accordingly the suction/discharge unit 311 has a lower pressure. Accordingly, the upper and lower portions of the oil valve 360 which are not fixed by the second compression coil spring 332 have a tendency to move towards the suction/discharge unit 311. Here, the upper portion of the oil valve 360 does not move by being latched by an end portion 314*a* of the discharge cover and oil valve receiving unit 314, so that the oil discharge side is not open, while the lower portion thereof moves towards the suction/discharge unit 311 centering around the center of the lower portion thereof, thereby opening the oil suction side, so that the oil is flowed into the oil supply tube 310 from the bottom of the hermetic vessel C.

Figure 14B:
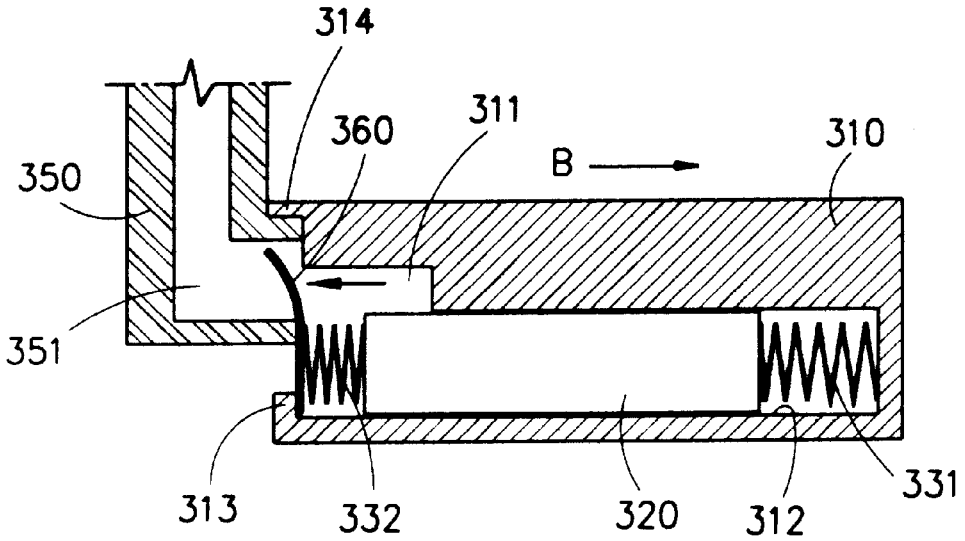
FIG. 14B is a vertical cross-sectional view illustrating a location of an oil valve when discharging an oil according to a third embodiment of the present invention.

On the contrary, as shown in FIG. 14B, when the oil supply tube 310 moves in a direction 'B', the mass 320 moves opposite to the direction 'B' by the inertial force, thereby thrusting the oil out of the suction/discharge unit 311, which moves the upper portion of the oil valve 360 towards the discharge cover 350 centering around the center of the upper portion thereof, so that the oil discharge side is opened and thus the oil is flowed into the oil pocket P of the compressor unit 10 through the oil path 351. Here, the lower portion of the oil valve 360 does not move by being latched by the oil valve latching protrusion 313, so that the oil suction side is not opened. That is, in the oil supply apparatus for the linear compressor according to the third embodiment of the present invention, while disposing the valve which controls the suction and discharge of the oil in the oil supply means, the suction and discharge of the oil is securely processed, thereby improving the efficiency of the device.

As described above, the oil supply apparatus for the linear compressor according to the present invention enables the fabrication and assembly of the valve which controls the oil suction and discharge, and during the opening/closing of the valve, any part thereof does not interfere with other constituent elements, thereby improving the reliability of the compressor.

It will be apparent to those skilled in the art that various modifications and variations can be made in the oil supply apparatus for the linear compressor of the present invention without departing from the spirit or scope of the invention. Thus, it is intended that the present invention cover the modifications and variations of this invention provided they come within the scope of the appended claims and their equivalents.

What is claimed is:

1. An oil supply apparatus for a linear compressor, comprising:

a compressor unit in which an oil discharge outlet is formed;

an oil supply pipe having a discharge outlet disposed at an outer side of the compressor unit, an end of which oil supply pipe communicates with one end of the oil discharge outlet;

an oil valve positioned at the discharge outlet of the oil supply pipe and having one end which is fixedly engaged with a side portion of the compressor unit and having another end which is selectively in contact with another end of the oil discharge outlet; and a discharge cover positioned at an outer side of the oil valve and engaged with the compressor unit, so that an oil path is formed between the discharge cover and the compressor unit.

2. The oil supply apparatus according to claim 1, wherein a mass is slidingly inserted in the oil supply pipe both ends thereof being connected with elastic members, respectively, the mass inertially moving in accordance with the movement of the oil supply pipe.

3. The oil supply apparatus according to claim 1, wherein the other end of the oil supply pipe is compressively inserted into a suction cover in which an oil suction inlet is formed, so that the suction cover is fixed to the compressor unit.

4. The oil supply apparatus according to claim 3, wherein a ring-shaped groove is formed on a side surface of the suction cover facing the oil supply pipe, so that the other end of the oil supply pipe is compressively inserted thereto.

5. The oil supply apparatus according to claim 3, wherein the oil suction inlet is formed smaller than the oil discharge outlet.

6. The oil supply apparatus according to claim 1, wherein a rectangular recess is formed on a side surface of the discharge cover facing the oil supply pipe to form the oil path between the discharge cover and the compressor unit.

7. The oil supply apparatus according to claim 1, wherein the oil valve consists of a body, a mounting portion which forms a 'T' shape with the body and is fixedly attached to the side portion of the compressor unit, and a ring-shaped opening/closing unit selectively contacting with the other end of the oil discharge outlet.

8. The oil supply apparatus according to claim 1, wherein the other end of the oil supply pipe is closed.

9. The oil supply apparatus according to claim 1, wherein an oil suction inlet is formed in a bottom of the oil supply pipe.

10. The oil supply apparatus according to claim 9, wherein the oil suction inlet is formed in a predetermined portion of the bottom of the oil supply pipe by the side of the oil discharge outlet.

11. The oil supply apparatus according to claim 9, wherein the oil suction inlet is selectively open and closed.

12. The oil supply apparatus according to claim 9, wherein the oil suction inlet is formed smaller than the oil discharge outlet.

13. The oil supply apparatus according to claim 2, wherein an outer circumferential surface of the mass is in tight sliding contact with an inner circumferential surface of the oil supply pipe.

14. The oil supply apparatus according to claim 1, wherein a plurality of oil supply pipes are disposed in parallel, one of which has an oil suction inlet formed in a bottom thereof.

15. The oil supply apparatus according to claim 14, wherein the oil supply pipe having the oil suction inlet is disposed at the oil discharge side.

16. The oil supply apparatus according to claim 14, wherein an end portion of a mass inserted in the plurality of oil supply pipes is protruded from the oil supply pipe and a plate spring is fixed to the protruded end portion thereof, the plate spring being connected with the compressor unit.

17. The oil supply apparatus according to claim 2, wherein the elastic members are compression coil springs.

18. An oil supply apparatus for a linear compressor, comprising:

a compressor unit;

a discharge cover engaged with the compressor unit, in which there is formed an oil path communicating with an oil pocket of the compressor unit;

an oil supply tube having a discharge end and an upper semicircle of an open end of which is compressively inserted into an end of the discharge cover; and an oil valve disposed at the discharge end of the oil supply tube and the discharge cover.

19. The oil supply apparatus according to claim 18, wherein a mass is slidingly inserted in the oil supply pipe both ends thereof being connected with one sides of elastic members, respectively, and a center of a side surface of the oil valve is fixed to the other side of the elastic member by the side of the discharge cover, the mass inertially moving in accordance with the movement of the oil supply pipe.

20. The oil supply apparatus according to claim 18, wherein the oil valve is formed in a disk type and extended from a top to a bottom of the inside of the oil supply tube.

21. The oil supply apparatus according to claim 18, wherein the inside of the oil supply tube becomes narrower, as being more distant from an oil discharge side, the inside thereof being stepped at least twice.

22. The oil supply apparatus according to claim 21, wherein a discharge cover and oil valve receiving unit is provided at an end of the oil supply tube facing the discharge cover and a suction/discharge unit is provided in a space which is formed being stepped towards the opposite side of the discharge cover side from the discharge cover and oil valve receiving unit.

23. The oil supply apparatus according to claim 22, wherein an oil valve latching protrusion is upwardly protruded from an end of the bottom of the oil supply tube placed directly under the discharge cover and oil valve receiving unit, the oil valve latching protrusion selectively contacting with a lower end portion of the oil valve.

24. The oil supply apparatus according to claim 18, wherein a center of a side surface of the oil valve is fixed to a bottom portion of the discharge cover and an outer circumferential portion thereof is not physically constrained.

25. The oil supply apparatus according to claim 20, wherein an upper part of the oil valve selectively opens/closes the oil discharge side of the oil supply tube and a lower part thereof selectively opens/closes the oil suction side of the oil supply tube.

26. The oil supply apparatus according to claim 19, wherein the elastic members are compression coil springs.

* * * * *